US008693901B2

(12) United States Patent
Watanabe et al.

(10) Patent No.: US 8,693,901 B2
(45) Date of Patent: Apr. 8, 2014

(54) TRANSFER DEVICE AND IMAGE FORMING APPARATUS

(75) Inventors: Sho Watanabe, Kanagawa (JP); Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 229 days.

(21) Appl. No.: 13/368,128

(22) Filed: Feb. 7, 2012

(65) Prior Publication Data

US 2013/0011151 A1 Jan. 10, 2013

(30) Foreign Application Priority Data

Jul. 7, 2011 (JP) ..... 2011-150738

(51) Int. Cl.
*G03G 15/00* (2006.01)

(52) U.S. Cl.
USPC ..... 399/44; 399/45; 399/66; 399/302

(58) Field of Classification Search
USPC ..... 399/44, 45, 66, 299, 302, 313
See application file for complete search history.

(56) References Cited

U.S. PATENT DOCUMENTS

| | | | | |
|---|---|---|---|---|
| 5,708,938 | A | 1/1998 | Takeuchi et al. | |
| 6,556,802 | B2 * | 4/2003 | Sasamoto et al. | 399/299 |
| 7,606,507 | B2 * | 10/2009 | Soshiroda | 399/66 |

FOREIGN PATENT DOCUMENTS

| | | | |
|---|---|---|---|
| JP | 05-341670 | A | 12/1993 |
| JP | 8-254907 | A | 10/1996 |
| JP | 10-186882 | A | 7/1998 |
| JP | 11-024444 | A | 1/1999 |
| JP | 2002-099162 | A | 4/2002 |

* cited by examiner

*Primary Examiner* — Hoang Ngo
(74) *Attorney, Agent, or Firm* — Sughrue Mion, PLLC

(57) ABSTRACT

A transfer device includes a transfer device, a facing member, and a prepressing member. The transfer member transfers a toner image, which is carried on an intermediate transfer member, to a recording medium. The facing member is disposed so as to be in pressed contact with the transfer member with the intermediate transfer member therebetween. The prepressing member is disposed so as to be in pressed contact with the transfer member with the intermediate transfer member therebetween at a position that is upstream of a contact section in which the facing member is in pressed contact with the transfer member and that is immediately behind a position at which the toner image starts to come into contact with the recording medium. A pressure applied by the prepressing member is lower than a pressure with which the facing member is in pressed contact with the transfer member.

17 Claims, 12 Drawing Sheets

EVALUATION RESULT

| | 1.5 mm | 2.5 mm | 3.5 mm | 4.5 mm |
|---|---|---|---|---|
| WHEN PREPRESSING ROLLER WAS NOT PROVIDED | G0 | G2 | G4 | G0 |
| WHEN PREPRESSING ROLLER WAS PROVIDED | G0 | G0 | G0 | G0 |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2011-150738 filed Jul. 7, 2011.

BACKGROUND (i) Technical Field

The present invention relates to a transfer device and an image forming apparatus.

(ii) Related Art

There are image forming apparatuses that include an intermediate transfer member to which toner images in different colors are multi-transferred and that form a color image or the like by simultaneously transferring the toner images, which have been multi-transferred to the intermediate transfer member, to a recording medium by using a transfer roller.

SUMMARY

According to an aspect of the invention, a transfer device includes a transfer device, a facing member, and a prepressing member. The transfer member transfers a toner image, which is carried on an intermediate transfer member that rotates, to a recording medium. The facing member is disposed so as to be in pressed contact with the transfer member with the intermediate transfer member therebetween. The prepressing member is disposed so as to be in pressed contact with the transfer member with the intermediate transfer member therebetween at a position that is upstream, in a direction in which the intermediate transfer member moves, of a contact section in which the facing member is in pressed contact with the transfer member and that is immediately behind a position at which the toner image carried on the intermediate transfer member starts to come into contact with the recording medium. A pressure applied by the prepressing member is lower than a pressure with which the facing member is in pressed contact with the transfer member.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described with reference to the drawings.

First Exemplary Embodiment

Figure 2:
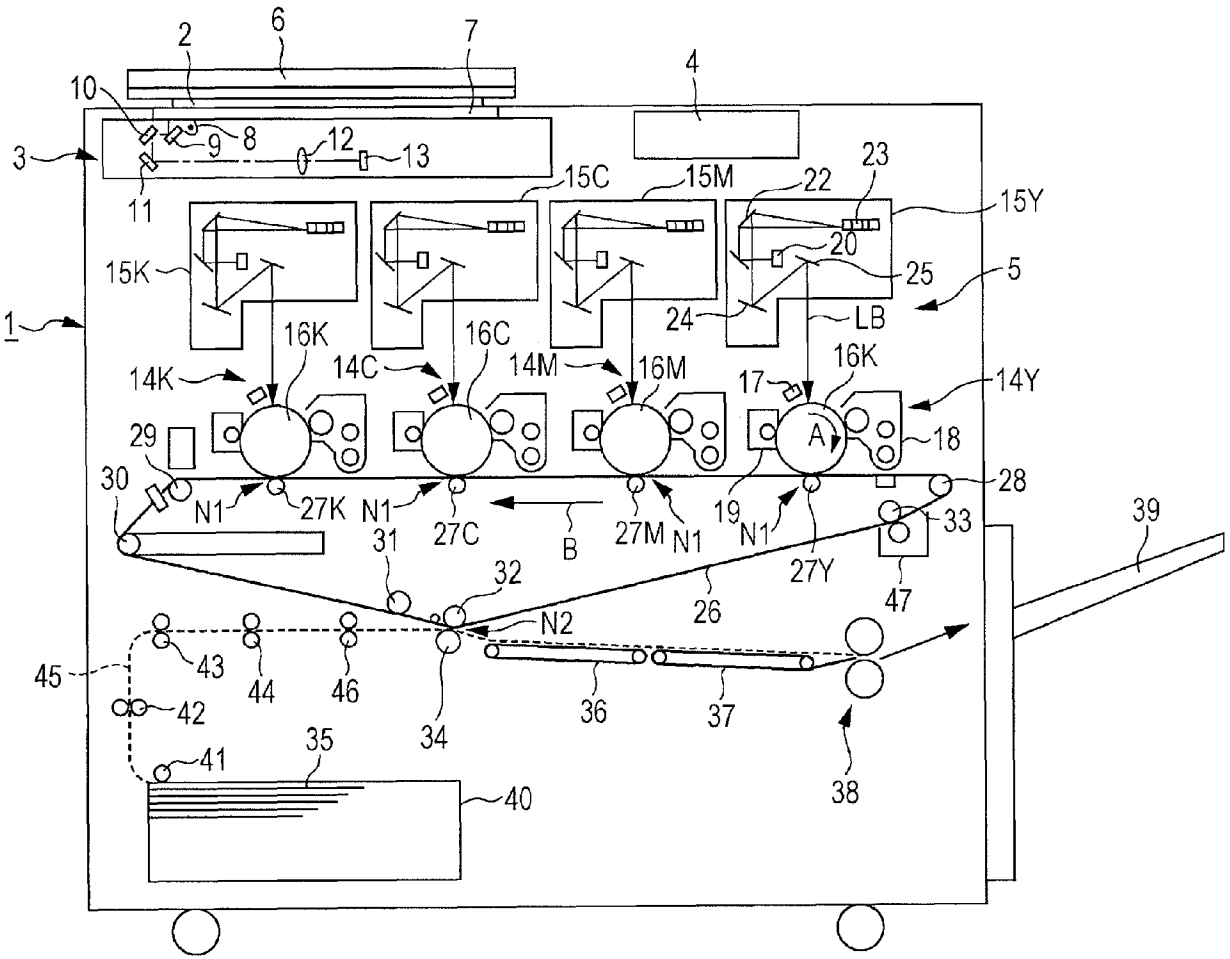
FIG. 2 is an overall view of the image forming apparatus including the transfer device according to the first exemplary embodiment of the present invention.

FIG. 2 is a schematic view of a tandem-type digital color printer, which is an example of an image forming apparatus including a transfer device according to a first exemplary embodiment of the present invention. The tandem-type digital color printer includes an image reading apparatus and also functions as a full color copier and a facsimile. The image forming apparatus need not include an image reading apparatus and may form an image on the basis of image data that is output from a personal computer or the like (not shown).

As illustrated in FIG. 2, an image forming apparatus body 1 includes an image reader 3 in an upper side portion thereof (the upper left side in FIG. 2). The image reader 3 reads an image of a document 2. An image processor 4 and an image output device 5 are disposed in the image forming apparatus body 1. The image processor 4 performs predetermined image processing on image data that is output from the image reader 3, a personal computer, or the like (not shown) or sent through a telephone line, a LAN, or the like. The image output device 5 outputs an image on the basis of image data on which predetermined image processing has been performed by the image processor 4.

The image reader 3 functions as follows: a document pressing cover 6 is opened, the document 2 is placed on a platen glass 7; the document pressing cover 6 is closed; the document 2 on the platen glass 7 is illuminated by a light source 8; a light image reflected from the document 2 is scanned onto an image reading device 13, such as a CCD, through a reduction scanning optical system that includes a full rate mirror 9, half rate mirrors 10 and 11, and an imaging lens 12; and an image of the document 2 is read by the image reading device 13 with a predetermined dot density.

The image of the document 2, which has been read by the image reader 3, is sent to the image processor 4 as, for example, document reflection data for three colors, i.e. red (R), green (G), blue (B) (for example, 8-bit color data). The image processor 4 performs predetermined image processing on the reflection data of the document 2, such as shading correction, displacement correction, brightness/color space conversion, gamma correction, frame erasing, and color/movement edition.

The image data, on which the image processor 4 has performed a predetermined image processing, is converted to four-color image data in yellow (Y), magenta (M), cyan (C), and black (K) by the image processor 4. The image data is sent to image exposure devices 15Y, 15M, 15C, and 15K of image forming units 14Y, 14M, 14C, and 14K for yellow (Y), magenta (M), cyan (C), and black (K). Each of the image exposure devices 15Y, 15M, 15C, and 15K performs image exposure in accordance with image data for the corresponding color by using a laser beam LB.

As described above, four image forming units 14Y, 14M, 14C, and 14K for yellow (Y), magenta (M), cyan (C), and black (K) are parallelly arranged in the image forming apparatus body 1 in the horizontal direction with a predetermined distance therebetween.

Referring to FIG. 2, the four image forming units 14Y, 14M, 14C, and 14K are the same except for the color of images formed therewith. Each of the image forming units 14Y, 14M, 14C, and 14K includes a photoconductor drum 16, a scorotron 17, an image exposure device 15, a developing device 18, and a cleaning device 19. The photoconductor drum 16, which serves as an image carrier, is rotated in the direction of arrow A at a predetermined speed (for example, process speed=440 mm/sec). The scorotron 17 uniformly charges the surface of the photoconductor drum 16 for first charging. The image exposure device 15, which serves as an image writer, forms an electrostatic latent image on the surface of the photoconductor drum 16 by performing image exposure on the basis of image data for a corresponding color. The developing device 18, which serves as a developing unit, develops the electrostatic latent image formed on the photoconductor drum 16 by using a toner. The cleaning device 19 removes residual toner that remains unused on the surface of the photoconductor drum 16.

Referring to FIG. 2, the image processor 4 successively outputs image data for corresponding colors to the image exposure devices 15Y, 15M, 15C, and 15K of the image forming units 14Y, 14M, 14C, and 14K for yellow (Y), magenta (M), cyan (C), and black (K). Laser beams LB are emitted from the image exposure devices 15Y, 15M, 15C, and 15K in accordance with the image data; the laser beams LB are scanned onto the surfaces of the corresponding photoconductor drums 16Y, 16M, 16C, and 16K so as to expose the photoconductor drums; and thereby electrostatic latent images are formed on the photoconductor drums 16Y, 16M, 16C, and 16K. Developing devices 18Y, 18M, 18C, and 18K reversely develop the electrostatic latent images, which have been formed on the surfaces of the photoconductor drums 16Y, 16M, 16C, and 16K; and thereby form toner images that are formed of yellow (Y), magenta (M), cyan (C), and black (K) toners (which are negatively charged).

Referring to FIG. 2, first transfer rollers 27Y, 27M, 27C, and 27K, which serve as a first transfer unit, multi-transfer the yellow (Y), magenta (M), cyan (C), and black (K) toner images, which have been successively formed on the photoconductor drums 16Y, 16M, 16C, and 16K of the image forming units 14Y, 14M, 14C, and 14K, to an intermediate transfer belt 26 at first transfer positions N1. The intermediate transfer belt 26, which is shaped like an endless belt and serves as an intermediate transfer member, is disposed below the image forming units 14Y, 14M, 14C, and 14K. A voltage having a positive polarity, which is opposite to that of the negative charge on the toner, is applied to the first transfer rollers 27Y, 27M, 27C, and 27K. At this time, current control is performed so that uniform currents flow through the metal rotary shafts of the first transfer rollers 27Y, 27M, 27C, and 27K. The intermediate transfer belt 26 is looped over a driving roller 28, a tension roller 29, a meandering-control roller 30, a driven roller 31, a backup roller 32, and a driven roller 33 with a predetermined tension. The driving roller 28 moves the intermediate transfer belt 26 in the direction of arrow B at a predetermined speed (for example, about 440 mm/sec, which is substantially the same as the process speed, i.e. rotation speed of the photoconductor drums). The intermediate transfer belt 26 is made by, for example, forming a plastic film strip of a synthetic resin, such as a polyimide resin or a polyamide-imide resin, and connecting the ends of the film strip to each other by plastic-welding or the like so as to form an endless belt. Alternatively, a preformed endless film belt may be used.

The backup roller 32, which serves as a facing member, applies a transfer voltage having a (negative) polarity, which is the same as that of the toner, to the yellow (Y), magenta (M), cyan (C), and black (K) toner images, which have been multi-transferred to the intermediate transfer belt 26. A second transfer roller 34, which serves as a second transfer member, simultaneously second-transfers the toner images to a recording sheet 35, which serves as a recording medium, at a second transfer position N2 by using an electrostatic force. The second transfer roller 34 is in pressed contact with the backup roller 32 and is grounded. Two transport belts 36 and 37 transport the recording sheet 35, to which the toner images have been transferred in accordance with the color of an image to be formed, to a fixing unit 38. At this time, a negative voltage, which has a polarity opposite to that of the charge on the toner and which is controlled to be uniform, is applied to the backup roller 32 so that a uniform voltage is applied to the metal rotary shaft of the backup roller 32. The fixing unit 38 performs a fixing process by applying heat and pressure to the recording sheet 35, to which the color toner images have been transferred, and then the recording sheet 35 is output to an output tray 39 that is disposed outside the image forming apparatus body 1.

Referring to FIG. 2, the recording sheet 35, which has a desired size and quality, is fed from a feed tray 40 disposed in a bottom portion of the image forming apparatus body 1 while being independently separated by a feed roller 41 and a separation roller (not shown). The recording sheet 35 is temporarily transported to a registration roller 46 through a sheet transport path 45, along which plural transport rollers 42, 43, and 44 are arranged. The recording sheet 35 fed from the feed tray 40 is transported to the second transfer position N2 on the intermediate transfer belt 26 by the registration roller 46 that is rotated at predetermined timings. Although only one feed tray 40 is illustrated in FIG. 2, there may be plural feed trays that contain recording sheets 35 having different or the same sizes.

Before the recording sheet 35 reaches the second transfer position N2, the four image forming units 14Y, 14M, 14C, and 14K for yellow, magenta, cyan, and black successively form yellow, magenta, cyan, and black toner images at predetermined timings as described above.

After the toner images have been transferred, the cleaning devices 19Y, 19M, 19C, and 19K remove residual toner from the photoconductor drums 16Y, 16M, 16C, and 16K to prepare for the next image forming process. A belt cleaner 47, which is disposed so as to face the driven roller 33, removes residual toner, paper dust, and the like from the intermediate transfer belt 26.

The process speed of the image forming apparatus having the structure described above is set, for example, as high as 440 mm/sec as described above in order to increase the productivity, which is measured by the number of the recording sheets 35 on which images are formed per unit time. The inventors have found that an image defect that has not occurred or only negligibly occurred in existing low-speed or medium-speed apparatuses occurs in such a high-speed apparatus. Note that an image forming apparatus according to an exemplary embodiment of the present invention is not limited to a high-speed apparatus and may be a medium-speed or low-speed apparatus.

The inventors have found the following facts.

Referring to FIG. 2, in the image forming apparatus, not only the photoconductor drums 16Y, 16M, 16C, and 16K but also the intermediate transfer belt 26, to which yellow (Y), magenta (M), cyan (C), and black (K) toner images are first-transferred from the photoconductor drums 16Y, 16M, 16C, and 16K are rotated at the process speed, which is as high as 440 mm/sec as described above. Therefore, referring to FIGS. 3 and 4, in the image forming apparatus, air 53 enters a space between a surface of the intermediate transfer belt 26 and the recording sheet 35 and becomes compressed when toner images 51 in different colors, which have been first-transferred to the intermediate transfer belt 26, are simultaneously second-transferred to the recording sheet 35. As a result, scattering of particles of the unfixed toner images 51 occurs when the toner images 51 are second-transferred to the recording sheet 35. In particular, scattering of particles of the toner images 51 that represent a straight line extending in a direction in which the intermediate transfer belt 26 moves occurs frequently.

Figure 3:
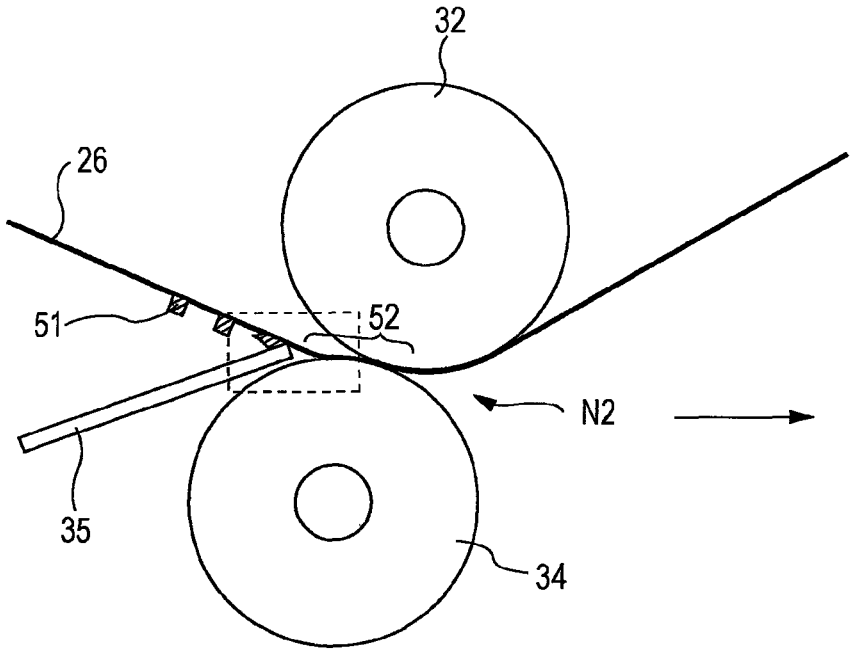
FIG. 3 illustrates an existing second transfer unit.
Figure 4:
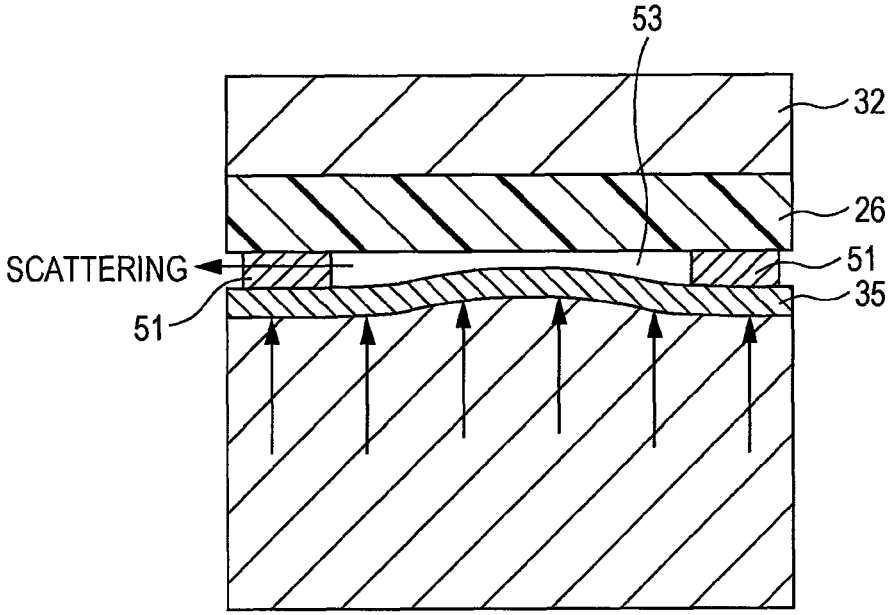
FIG. 4 illustrates the mechanism by which scattering of particles of a toner image occurs.

To be specific, referring to FIG. 3, as the intermediate transfer belt 26 moves, each of the toner image 51, which has been second-transferred to the intermediate transfer belt 26, moves to a press-contact section (contact section) 52 at the second transfer position N2, at which the second transfer roller 34 and the backup roller 32 are in pressed contact with each other. The recording sheet 35 moves to the press-contact section 52 at the second transfer position N2 in sync with the toner image 51 on the intermediate transfer belt 26.

In the present exemplary embodiment, the backup roller 32 is disposed at the position illustrated in FIG. 3 with consideration of ease of separation of the recording sheet 35 after the recording sheet 35 has passed through the press-contact section 52 at the second transfer position N2, at which the second transfer roller 34 and the backup roller 32 are in pressed contact with each other with the intermediate transfer belt 26 therebetween. That is, the backup roller 32 is disposed at a position that is displaced downstream, in the direction in which the intermediate transfer belt 26 moves, of the second transfer position N2 and that is displaced toward the second transfer roller 34. Therefore, as illustrated in FIG. 3, the intermediate transfer belt 26 first comes into contact with the surface of the second transfer roller 34 at the second transfer position N2. Subsequently, the intermediate transfer belt 26 enters the press-contact section 52, at which the second transfer roller 34 and the backup roller 32 are in pressed contact with each other, in a state in which the intermediate transfer belt 26 is wound around the surface of the second transfer roller 34 over a certain length.

Figure 6:
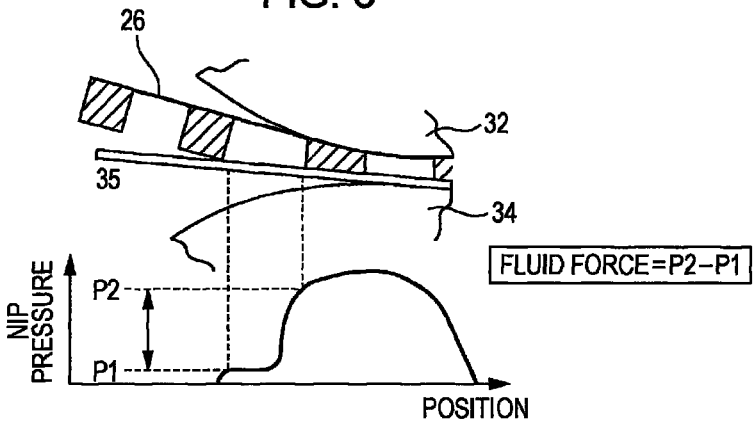
FIG. 6 illustrates the mechanism by which scattering of particles of a toner image occurs.

Therefore, as illustrated in FIG. 3, in this state, a part of the intermediate transfer belt 26 that is located upstream of the second transfer position N2 in the direction in which the intermediate transfer belt 26 moves and the surface of the second transfer roller 34 are in contact with each other without receiving a pressing force from the backup roller 32. Therefore, as illustrated in FIG. 6, the nip pressure P1 between the intermediate transfer belt 26 and the second transfer roller 34 is low.

Figure 5:
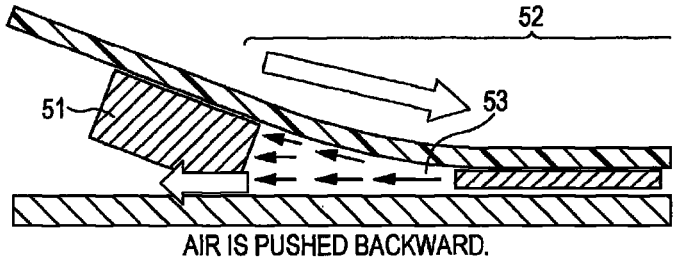
FIG. 5 illustrates the mechanism by which scattering of particles of a toner image occurs.

As illustrated in FIG. 5, the air 53, which is located in a space between the intermediate transfer belt 26 and the recording sheet 35 in such a state, is not vented from the space but is gradually compressed as the second transfer roller 34 and the backup roller 32 move toward the press-contact section 52, and thereby the air 53 is pushed backward with respect to the direction in which the intermediate transfer belt 26 moves. At this time, a toner image 51 that has been transferred to a position that is located backward with respect to the direction in which the intermediate transfer belt 26 moves, in particular, a toner image 51 that extends in a direction that intersects the direction in which the intermediate transfer belt 26 moves (a direction that is perpendicular to the plane of FIG. 5) is scattered by the air 53, which has been compressed in the press-contact section 52, backward with respect to the direction in which the intermediate transfer belt 26 moves. As a result, scattering of particles of the toner image 51 occurs.

Figure 7:
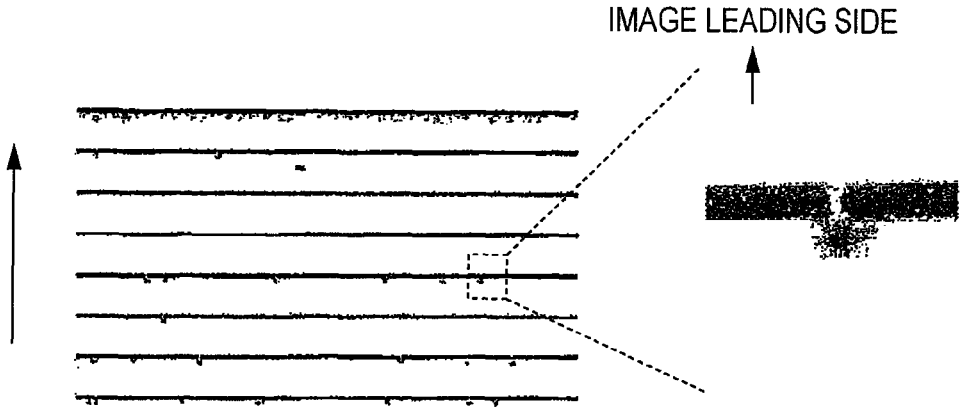
FIG. 7 is a schematic view illustrating scattering of particles of a toner image.

Referring to FIG. 7, such scattering of particles of the toner image 51 frequently occurs if the toner image 51 represents a black (K) straight line, which is a high-density image having an image density Cin of about 100% and which is often formed along a straight line that intersects the direction in which the intermediate transfer belt 26 moves. However, the color of the toner image 51 is not limited to black (K), and may be yellow (Y), magenta (M), or cyan (C).

Figure 8:
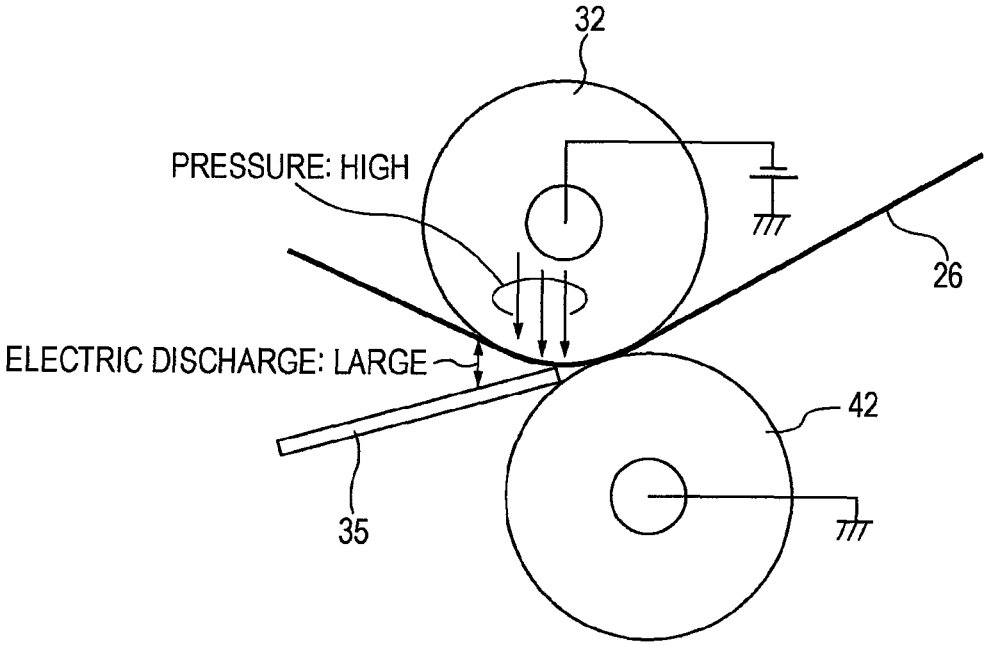
FIG. 8 illustrates a second transfer unit.
Figure 9:
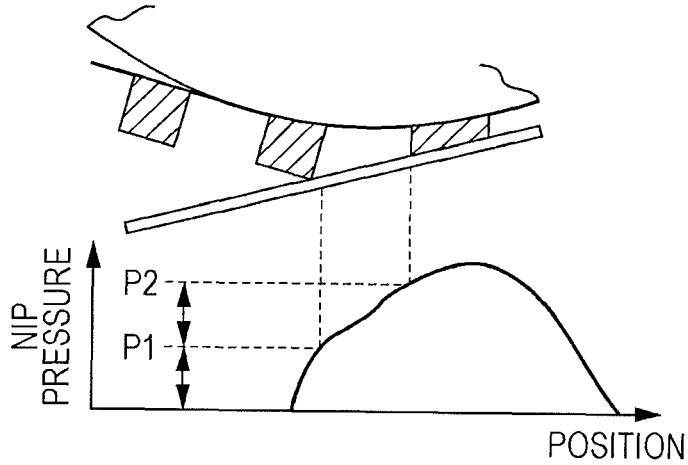
FIG. 9 illustrates the mechanism by which scattering of particles of a toner image is suppressed.

In order to suppress scattering of particles of the toner image 51 described above, the inventors examined a structure illustrated in FIG. 8. In the structure, the position of the backup roller 32, which supports the back surface of the intermediate transfer belt 26 at the second transfer position N2, is moved upstream in the direction in which the intermediate transfer belt 26 moves so as to increase the pressure P2 on the entrance side of the press-contact section 52, in which the second transfer roller 34 and the backup roller 32 are in pressed contact with each other, as illustrated in FIG. 9.

With such a structure, scattering of particles of the toner image 51 was suppressed to some extent. However, it was found that gap discharge between the intermediate transfer belt 26 and the recording sheet 35 occurred because there was a large distance between the distance between the intermediate transfer belt 26 and the recording sheet 35 at the entrance of the press-contact section 52 as illustrated in FIG. 8. As a result, another type of scattering due to the gap discharge occurred when the toner image 51 is second-transferred from the intermediate transfer belt 26 to the recording sheet 35.

Figure 10:
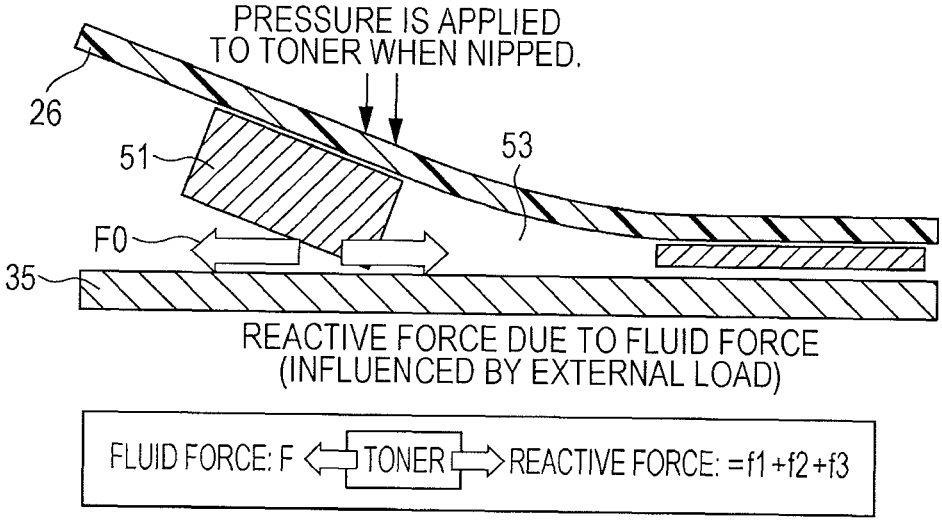
FIG. 10 illustrates the mechanism by which scattering of particles of a toner image is suppressed.

The inventors have analyzed forces that act on the toner image 51 at the second transfer position N2, at which the intermediate transfer belt 26 is in pressed contact with the recording sheet 35, as illustrated in FIG. 10; and have created a transfer device with which scattering of particles of the toner image 51 is suppressed while preventing scattering due to gap discharge.

Referring to FIG. 10, a fluid force F and a reactive force against the fluid force F act on the toner image 51. The fluid force F is generated by the air 53, which is compressed between the intermediate transfer belt 26 and the recording sheet 35. The reactive force includes a load f1, an electrostatic force f2, and a non-electrostatic force f3. The load f1 is a pressure that is applied from the outside to the entrance of the press-contact section 52 and that suppresses scattering of particles of the toner image 51 by pressing and concentrating the toner image 51. The electrostatic force f2 attracts the toner image 51 from the intermediate transfer belt 26 toward the recording sheet 35. The non-electrostatic force f3 is a Van der Waals force or the like with which the toner image 51 adheres to the intermediate transfer belt 26 and to the recording sheet 35. If the sum of the load f1, the electrostatic force f2, and the non-electrostatic force f3 is larger than the fluid force F, i.e. if the relationship f1+f2+f3>F is satisfied, scattering of particles of the toner image 51 is suppressed.

Figure 1:
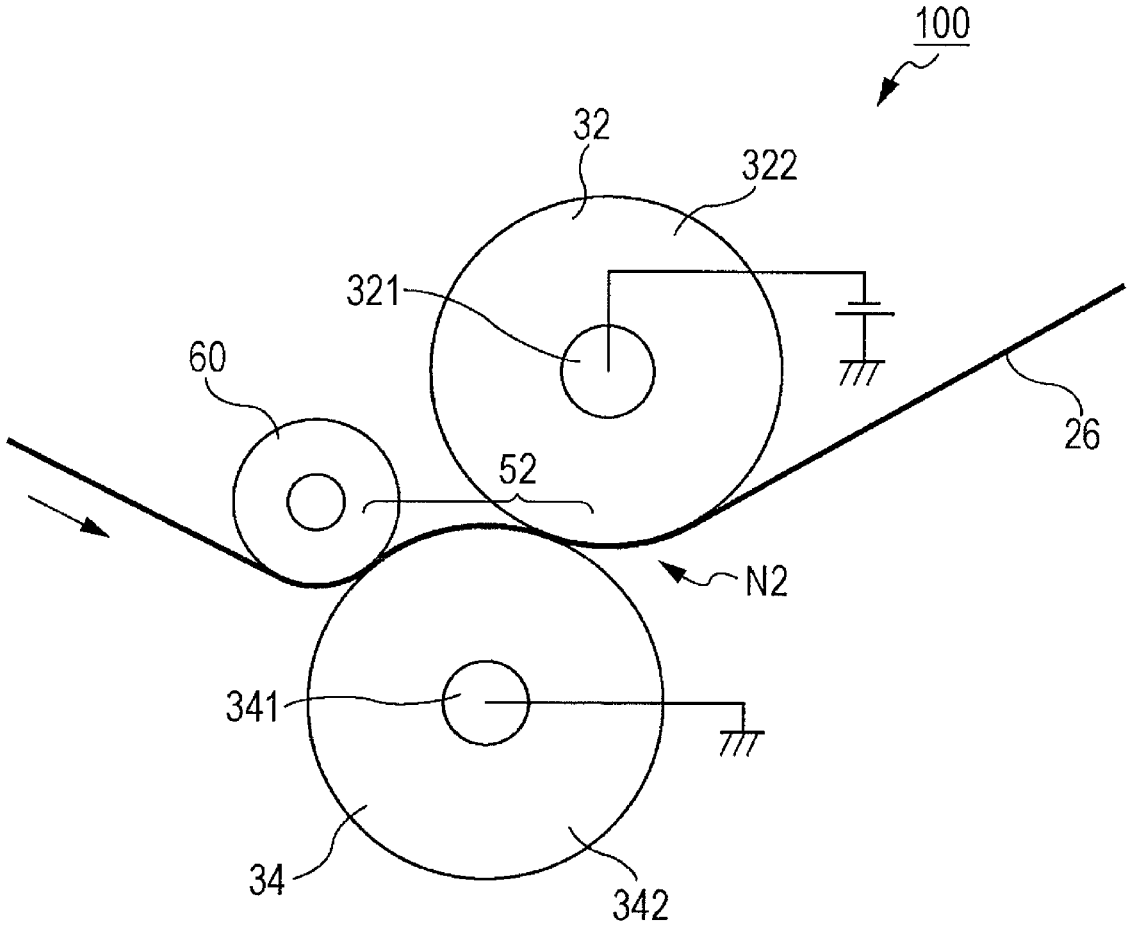
FIG. 1 is a partial schematic view of an image forming apparatus including a transfer device according to a first exemplary embodiment of the present invention.

Referring to FIG. 1, in a transfer device 100 according to the first exemplary embodiment, the backup roller 32 is disposed at a position the same as before with consideration of ease of separation of the recording sheet 35, i.e. at a position that is on the exit side of the press-contact section 52 and that is displaced toward the second transfer roller 34, which is the same as that illustrated in FIG. 3. Moreover, a prepressing roller 60, which serves as a prepressing member, is disposed so that the backup roller 32 comes into contact with the second transfer roller 34 with a pressure that is higher than the predetermined pressure with the intermediate transfer belt 26 therebetween.

The second transfer roller 34 includes, for example, a metal core 341 that is made of a stainless steel or the like and an elastic layer 342 that covers the outer periphery of the metal core 341 with a predetermined thickness. The elastic layer 342 is made of an electroconductive elastic material such as a rubber to which a conductive agent is added. Alternatively, a release layer may be formed on the surface of the elastic layer 342 of the second transfer roller 34. Likewise, the backup roller 32 includes, for example, a metal core 321 that is made of a stainless steel or the like and an elastic layer 322 that covers the outer periphery of the metal core 321 with a predetermined thickness. The elastic layer 322 is made of an electroconductive elastic material such as a rubber to which a conductive agent is added.

The backup roller 32 is rotatably disposed at a fixed position. The second transfer roller 34 is configured to be movable so as to come into contact with or to become separated away from the backup roller 32 by using a movement unit such as a driving motor or an eccentric cam (not shown). Therefore, the pressing force between the second transfer roller 34 and the backup roller 32 is adjustable.

Referring to FIG. 1, the prepressing roller 60 is a solid-cylindrical or a hollow-cylindrical member made of a metal such as a stainless steel, aluminium, or iron. The diameter (outer diameter) of the prepressing roller 60 is about a half the diameter of each of the second transfer roller 34 and the backup roller 32. In the present exemplary embodiment, a cylindrical roller-like member made of a stainless steel is used as the prepressing roller 60. The prepressing roller 60 is rotatably disposed at a fixed position. However, the prepressing member is not limited to a roller-like member made of a metal, as long as the prepressing member is capable of applying a pressure higher than a predetermined pressure. For example, the prepressing member may be made of a synthetic resin or may have a shape that is not roller-like.

The prepressing roller 60 is disposed at a position that is upstream, in the direction in which the intermediate transfer belt 26 moves, of a position at which the second transfer roller 34 and the backup roller 32 are in pressed contact with each other, that is separated from the backup roller 32 by a predetermined distance, and at which the prepressing roller 60 is in pressed contact with the surface of the second transfer roller 34 with the intermediate transfer belt 26 therebetween. The distance between the prepressing roller 60 and the backup roller 32 is determined with consideration of electrical insulation provided by an air gap between these rollers, because a bias voltage may be applied to the prepressing roller 60 as described below.

The distance between the recording sheet 35 and the intermediate transfer belt 26 when the recording sheet 35 reaches the second transfer position N2 is determined by the position of the prepressing roller 60. As described above, the diameter of the prepressing roller 60 is about a half the diameter of each of the second transfer roller 34 and the backup roller 32. Therefore, in contrast to the case illustrated in FIG. 8, when the recording sheet 35 enters the nip between the prepressing roller 60 and the second transfer roller 34, the distance between the intermediate transfer belt 26 and the recording sheet 35 at the entrance of the press-contact section 52 does not become large. As a result, occurrence of gap discharge between the intermediate transfer belt 26 and the recording sheet 35 is suppressed, and scattering, due to gap discharge, of particles of the toner image 51 when the toner image 51 is second-transferred from the intermediate transfer belt 26 to the recording sheet 35 does not occur.

Moreover, referring to FIG. 10, the pressure with which the prepressing roller 60 is in contact with the second transfer roller with the intermediate transfer belt therebetween is set such that the relationship f1+f2+f3>F is satisfied and thereby scattering of particles of the toner image 51 is suppressed. The pressure of the prepressing roller 60 directly determines the load f1. Referring to FIG. 9, the pressure is set at a value higher than a predetermined pressure with which scattering of particles of a toner image is suppressed as described above with consideration of experiment results and f2 and f3, which are other forces acting on the transfer device 100. The pressure of the prepressing roller 60 is set at, for example, about one third or a half the pressing force with which the second transfer roller 34 and the backup roller 32 are in pressed contact with each other.

However, if the pressure of the prepressing roller 60 is too low, the effect of suppressing scattering of particles of a toner image becomes insufficient. To increase the effect of suppressing scattering of particles of a toner image, the pressure at which the prepressing roller 60 is in pressed contact with the second transfer roller 34 with the intermediate transfer belt 26 therebetween may be high. However, if the pressure is too high, an image defect that may generate a hollow character or the like may occur.

Figure 11:
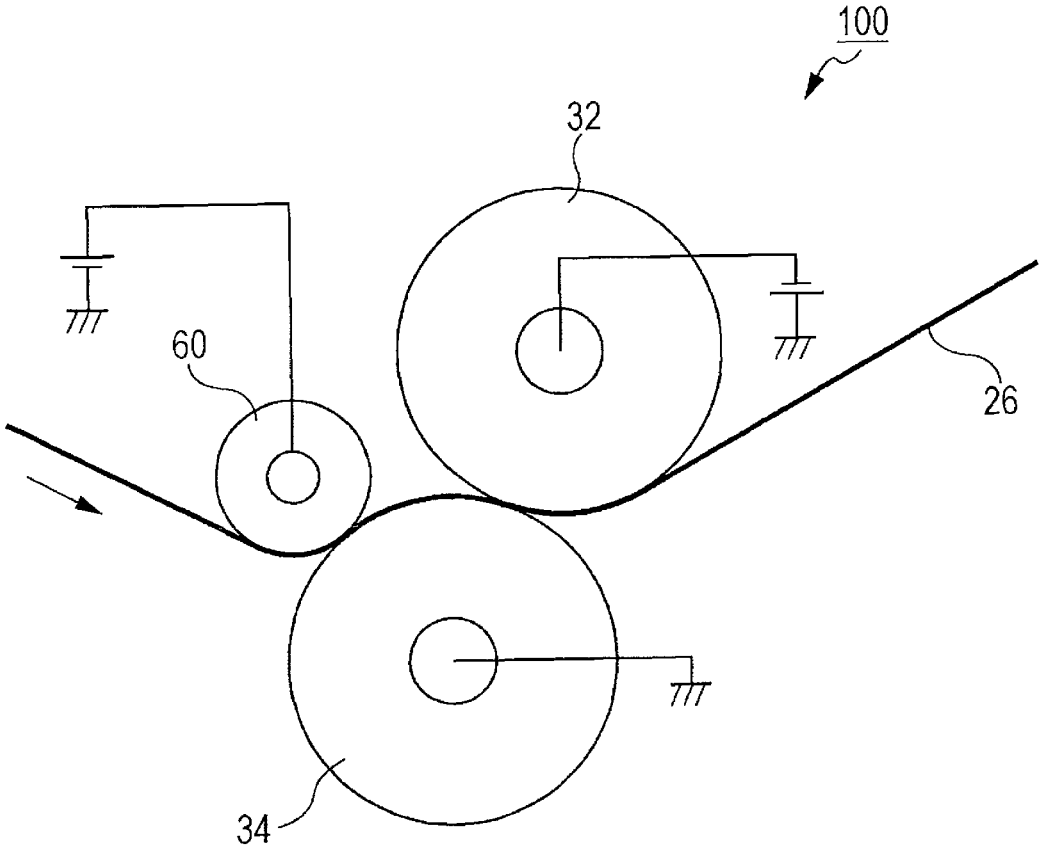
FIG. 11 illustrates a modification of the transfer device according to the first exemplary embodiment of the present invention.

Referring to FIG. 11, as a modification of the present exemplary embodiment, a voltage having a (positive) polarity opposite to that of the toner image 51 on the intermediate transfer belt 26 may be applied to the prepressing roller 60 by using a second power supply.

In this case, scattering of particles of the toner image 51 caused by gap discharge between the prepressing roller 60 and the intermediate transfer belt 26 is reliably prevented.

The image forming apparatus according to the present exemplary embodiment, having the structure described above, may further include a toner charge detector. In this case, scattering of particles of a toner image caused by air that is compressed in a space between the intermediate transfer member and a recording sheet is suppressed when transferring the toner image on the intermediate transfer member to a recording sheet.

That is, referring to FIG. 2, in the image forming apparatus according to the present exemplary embodiment, the image forming units 14Y, 14M, 14C, and 14K for yellow (Y), magenta (M), cyan (C), and black (K) form corresponding color images on the photoconductor drums 16Y, 16M, 16C, and 16K. A transfer current having a positive voltage and controlled to be a uniform current is applied to each of the first transfer rollers 27Y, 27M, 27C, and 27K at the first transfer position N1 and thereby the yellow (Y), magenta (M), cyan (C), and black (K) toner images formed on the photoconductor drums 16Y, 16M, 16C, and 16K are multi-transferred to the intermediate transfer belt 26. Subsequently, a second transfer voltage having a negative polarity and controlled at a predetermine voltage is applied to the backup roller 32 facing the second transfer roller 34 at the second transfer position N2 and thereby the yellow (Y), magenta (M), cyan (C), and black (K) toner images, which have been multi-transferred to the intermediate transfer belt 26, are simultaneously second-transferred to the recording sheet 35. Then, the fixing unit 38 fixes the unfixed toner images on the recording sheet 35 by applying heat and pressure, and the recording sheet 35 is output to the output tray 39.

As described above, in the image forming apparatus, the process speed is set, for example, as high as 440 mm/sec in order to increase the productivity that is measured by the number of the recording sheets 35 on which images are formed per unit time. Therefore, referring to FIGS. 3 and 4, in the image forming apparatus, when simultaneously second-transferring color toner images 51, which have been first-transferred to the intermediate transfer belt 26, to the recording sheet 35, the air 53 may be compressed between the surface of the intermediate transfer belt 26 and the recording sheet 35. As a result, scattering of particles of an unfixed toner image 51 that is second-transferred to the recording sheet 35, and in particular, scattering of particles of a toner image 51 that represents a straight line extending in the direction in which the intermediate transfer belt 26 moves may occur.

Referring to FIG. 1, in the present exemplary embodiment, at the second transfer position N2, at which the second transfer roller 34 and the backup roller 32 are in pressed contact with each other with the intermediate transfer belt 26 therebetween, the prepressing roller 60 is disposed at a position that is upstream of the press-contact section 52, at which the backup roller 32 is in pressed contact with the second transfer roller 34 with the intermediate transfer belt 26 therebetween. The prepressing roller 60 is in pressed contact with the second transfer roller 34 with a pressure that is higher than a predetermined pressure.

Figure 12:
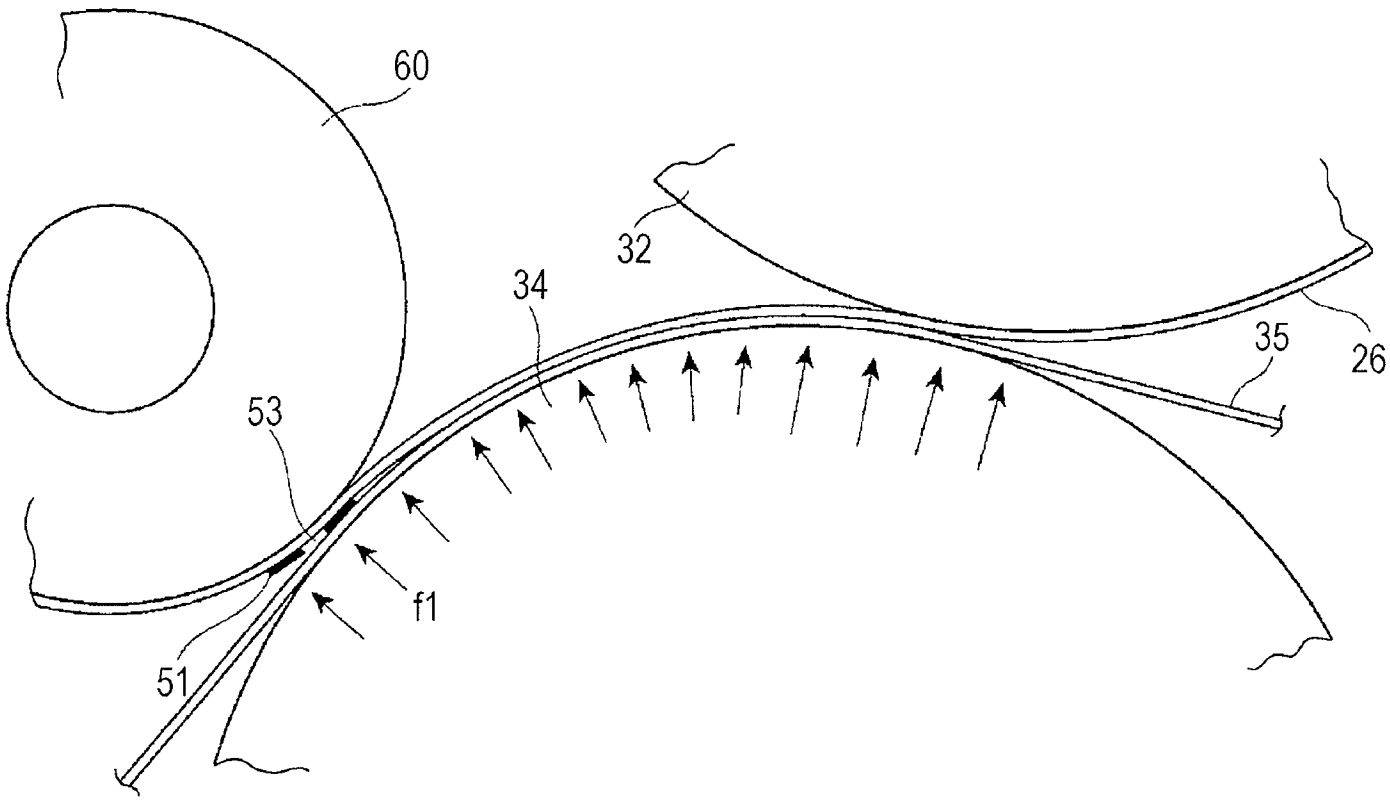
FIG. 12 illustrates the mechanism by which scattering of particles of a toner image is suppressed.

Referring to FIG. 12, in the present exemplary embodiment, the diameter of the prepressing roller 60, which comes into pressed contact with the second transfer roller 34 when the toner image 51 transferred to the intermediate transfer belt 26 comes into contact with the recording sheet 35, is set smaller than the diameter of the backup roller 32. Therefore, the volume of air located between the surface of the intermediate transfer belt 26 and the recording sheet 35 is smaller than that of the existing case illustrated in FIG. 3. Therefore, the fluid force F, which is generated when the air 53 is compressed between the surface of the intermediate transfer belt 26 and the recording sheet 35, is made smaller than that of the existing case illustrated in FIG. 3.

Moreover, referring to FIG. 12, in the present exemplary embodiment, immediately after the toner image 51, which has been transferred to the intermediate transfer belt 26, comes into contact with the recording sheet 35, the toner image 51 receives a pressing force f1 from the prepressing roller 60 that is in pressed contact with the second transfer roller 34. Therefore, referring to FIG. 10, even when the air 53 is compressed between the surface of the intermediate transfer belt 26 and the recording sheet 35 and a fluid force F is generated in the direction in which the intermediate transfer belt 26 moves, the prepressing roller 60 applies the pressing force f1 to a position that is immediately behind the position at which the toner image 51, which has been transferred to the intermediate transfer belt 26, comes into contact with the recording sheet 35.

As a result, a reactive force that is the sum of the pressing force f1 due to the prepressing roller 60 and other forces f2 and f3 exceeds the fluid force F, and thereby scattering of particles of an unfixed toner image 51 when the toner image 51 is second-transferred to the recording sheet 35, and in particular, scattering of particles of a toner image 51 that represents a straight line extending in the direction in which the intermediate transfer belt 26 moves is prevented or suppressed.

EXAMPLE

Figures 13, 14:
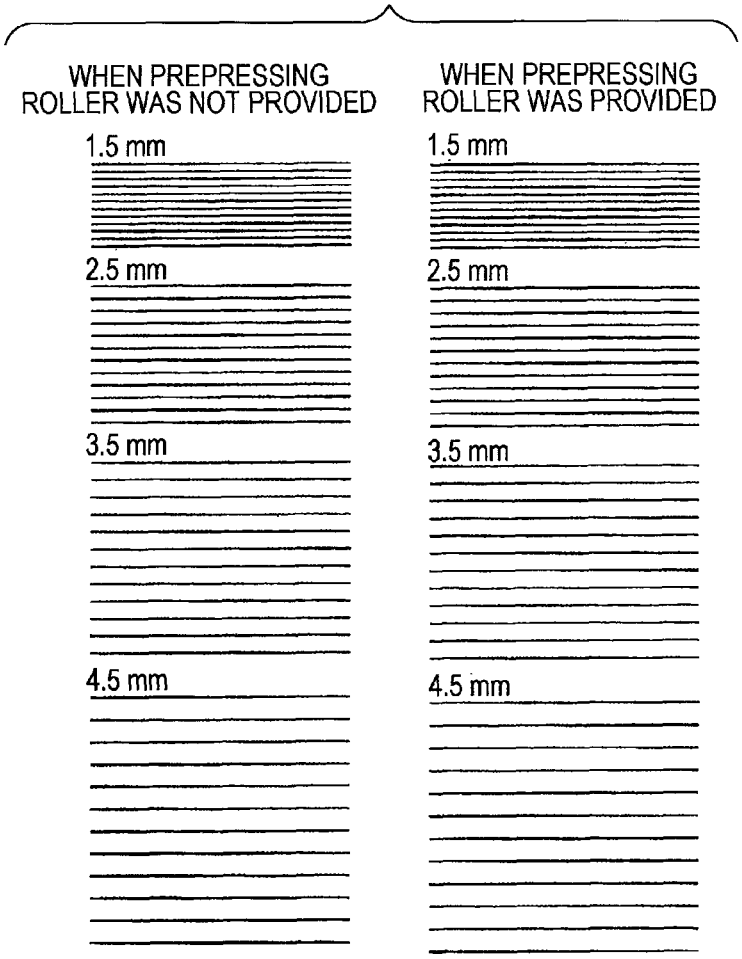
FIG. 13 is a schematic view illustrating an evaluation example of scattering of particles of a toner image.
FIG. 14 is a table illustrating an evaluation result of scattering of particles of a toner image.

The inventors made a prototype of an image forming apparatus including the transfer device 100 illustrated in FIGS. 1 and 2 in order to examine the function of the transfer device 100 according to the exemplary embodiment of the present invention and performed the following experiment. Referring to FIG. 13, straight line images 51 each having an 8-dot thickness and CK 200% are formed so as to extend in the axial direction of the photoconductor drum 16, i.e. in a direction that intersects the direction in which the intermediate transfer belt 26 moves, at intervals of 1.5 mm, 2.5 mm, 3.5 mm, and 4.5 mm in the direction in which the intermediate transfer belt 26 moves. Then, whether scattering of particles of a toner image occurred was visually checked in the case where the prepressing roller 60 was provided and in the case where the prepressing roller 60 was not provided. The sensory evaluation result was rated from G0: "No scattering occurred." to G5: "Scattering considerably occurred."

FIGS. 13 and 14 illustrate the results of the experiment.

As is clear from FIGS. 13 and 14, in the case where the prepressing roller 60 was not provided, scattering of particles of a toner image occurred when the intervals between the linear images 51 were 2.5 mm and 3.5 mm and the ratings were G2 and G4. In contrast, in the case where the prepressing roller 60 was provided, scattering of particles of a toner image did not occur for all the intervals from 1.5 to 4.5 mm between the linear images 51.

Second Exemplary Embodiment

Figure 15:
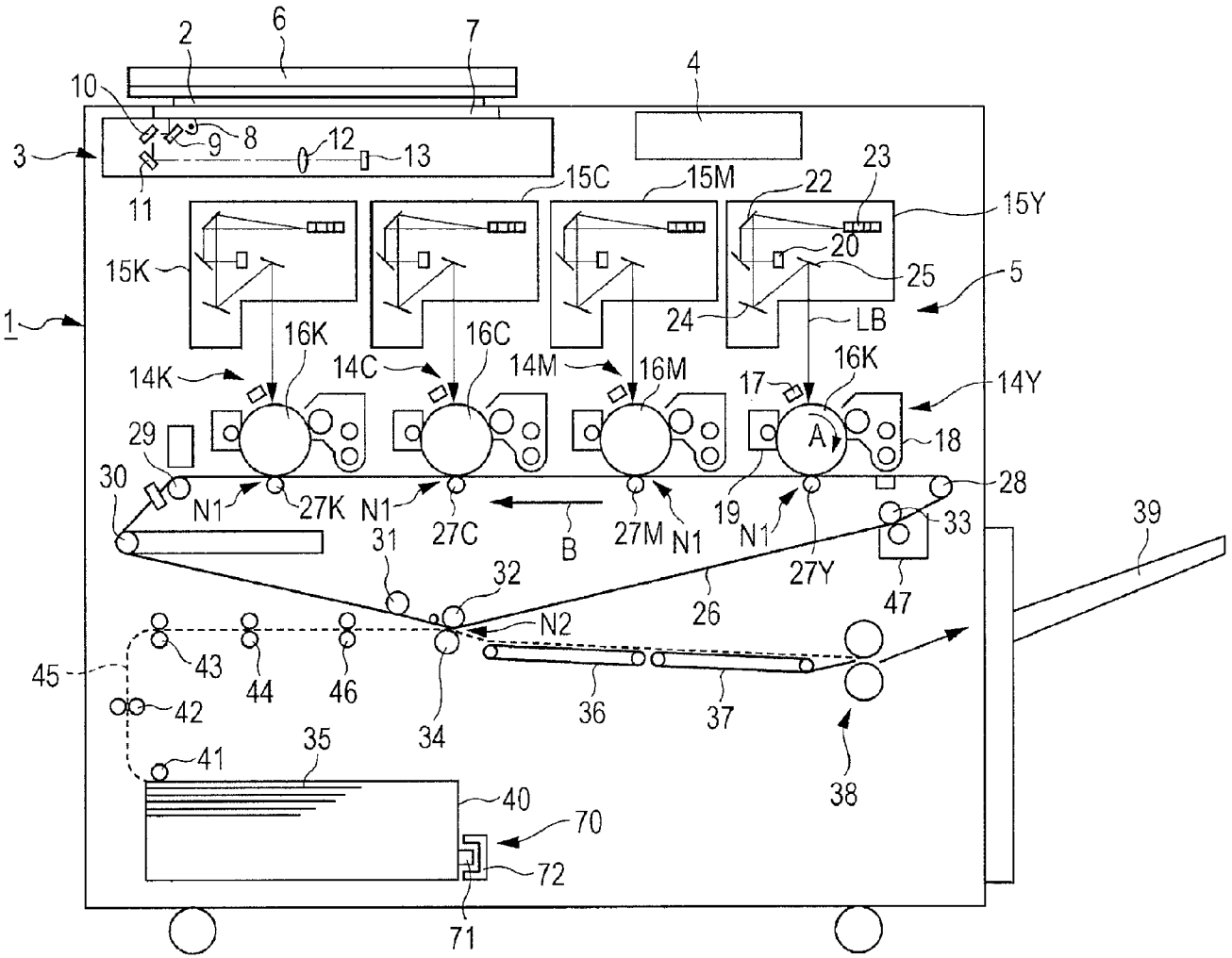
FIG. 15 is an overall view of an image forming apparatus including a transfer device according to a second exemplary embodiment of the present invention.

FIG. 15 illustrates a second exemplary embodiment of the present invention, in which the members the same as those of the first exemplary embodiment are denoted by the same numerals. In the second exemplary embodiment, the pressure applied to the prepressing member is controlled in accordance with the thickness of the recording sheet.

Referring to FIG. 15, in the second exemplary embodiment, a detection unit 70 is provided to the feed tray 40, which is disposed in a bottom portion of the image forming apparatus body 1. The detection unit 70 detects the thickness of a recording sheet contained in the feed tray 40. To identify, for example, the type, size, and thickness of the recording sheet 35 contained in the feed tray 40, the detection unit 70 includes a protrusion 71 disposed on the feed tray 40 and an identification sensor 72 that is attached to the image forming apparatus body 1 and that identifies the protrusion 71 of the feed tray 40.

Figure 16:
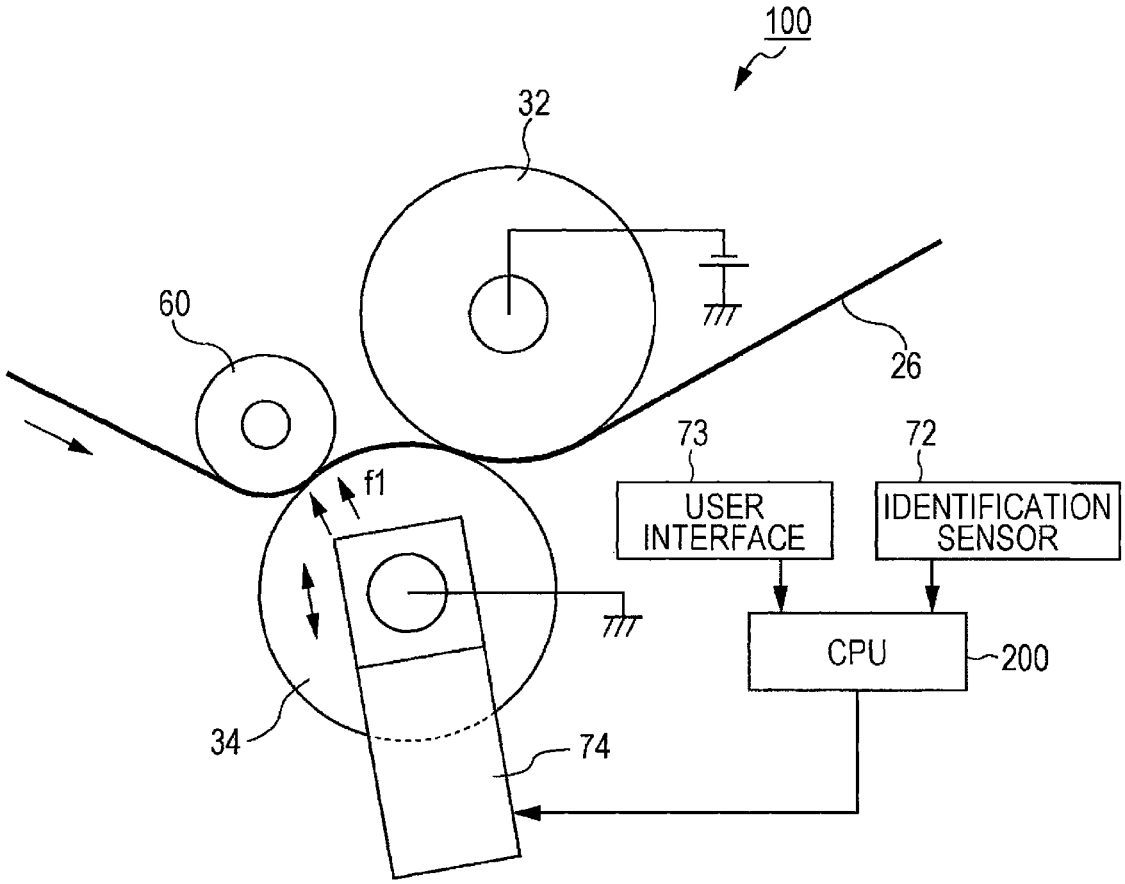
FIG. 16 is a partial schematic view of the image forming apparatus including the transfer device according to the second exemplary embodiment of the present invention.

Referring to FIG. 16, a user interface 73, with which a user inputs the type, the size, and the like of the recording sheet 35 when the user performs copying or printing, is used as a detection unit for detecting the thickness of the recording sheet 35. The thickness of a recording sheet is detected when a user inputs the type (including the thickness), the size, and the like of the recording sheet on which copying or printing is to be performed through the user interface 73.

Referring to FIG. 16, a CPU 200, which serves as a controller of the image forming apparatus, controls the pressing force with which the second transfer roller 34 is in pressed contact with the backup roller 32 and the prepressing roller 60 by using a pressing unit 74 on the basis of information on the thickness of the recording sheet 35 detected by the identification sensor 72 or the user interface 73.

Referring to FIG. 16, if the CPU 200 determines that the thickness of the recording sheet 35 is smaller than a predetermined threshold, i.e. the recording sheet 35 is a thin sheet, the CPU 200 sets the pressing force f1, with which the second transfer roller 34 is in pressed contact with the backup roller 32 and the prepressing roller 60, at a value larger than a predetermined value and thereby reliably suppresses scattering of particles of a toner image. Referring to FIG. 16, if the CPU 200 determines that the thickness of the recording sheet 35 is larger than the predetermined threshold, i.e. the recording sheet 35 is a thick sheet, the CPU 200 sets the pressing force, with which the second transfer roller 34 is in pressed contact with the backup roller 32 and the prepressing roller 60, at a value smaller than a predetermined value and thereby prevents an excessive pressure from being applied and prevents or suppresses occurrence of an image defect that may occur if an excessive concentration force is applied to the toner image 51.

Description of other structures and functions, which are the same as those of the first exemplary embodiment, is omitted.

Third Exemplary Embodiment

FIG. 2 also illustrates a third exemplary embodiment of the present invention, in which the members the same as those of the first exemplary embodiment are denoted by the same numerals. In the third exemplary embodiment, the pressure applied to the prepressing member is controlled in accordance with the electric charge of toner.

Referring to FIG. 2, in the third exemplary embodiment, the image processor 4 counts the number of pixels of image data for each color and determines whether the toner in each of the developing devices 18Y, 18M, 18C, and 18K is in a high charge state or in a low charge state on the basis of information such as the number of pixels per page and the number of the recording sheets 35 that have been continuously processed. An example of such information includes information that low density images each having the number of pixels per page that is smaller than a predetermined number have been formed on a predetermined number of the recording sheets 35 or more. Then, the image processor 4 controls the pressing force of the prepressing roller in accordance with the electric charge (the state of charge) of the toner.

If the toner in the developing devices 18Y, 18M, 18C, and 18K is in a low charge state, the pressing force with which the second transfer roller 34 is in pressed contact with the backup roller 32 and the prepressing roller 60 is set higher than a predetermined value in order to suppress scattering of particles of a toner image. If the toner in the developing devices 18Y, 18M, 18C, and 18K is in a high charge state, the pressing force with which the second transfer roller 34 is in pressed contact with the backup roller 32 and the prepressing roller 60 is set lower than a predetermined value in order to suppress scattering of particles of a toner image, prevent an excessive pressing force from being applied, and prevent or suppress occurrence of an image defect that may occur when an excessive concentration force is applied the toner image 51.

The electric charge of the toner may be detected by another toner charge detection unit.

Description of other structures and functions, which are the same as those of the first exemplary embodiment, is omitted.

Fourth Exemplary Embodiment

Figure 17:
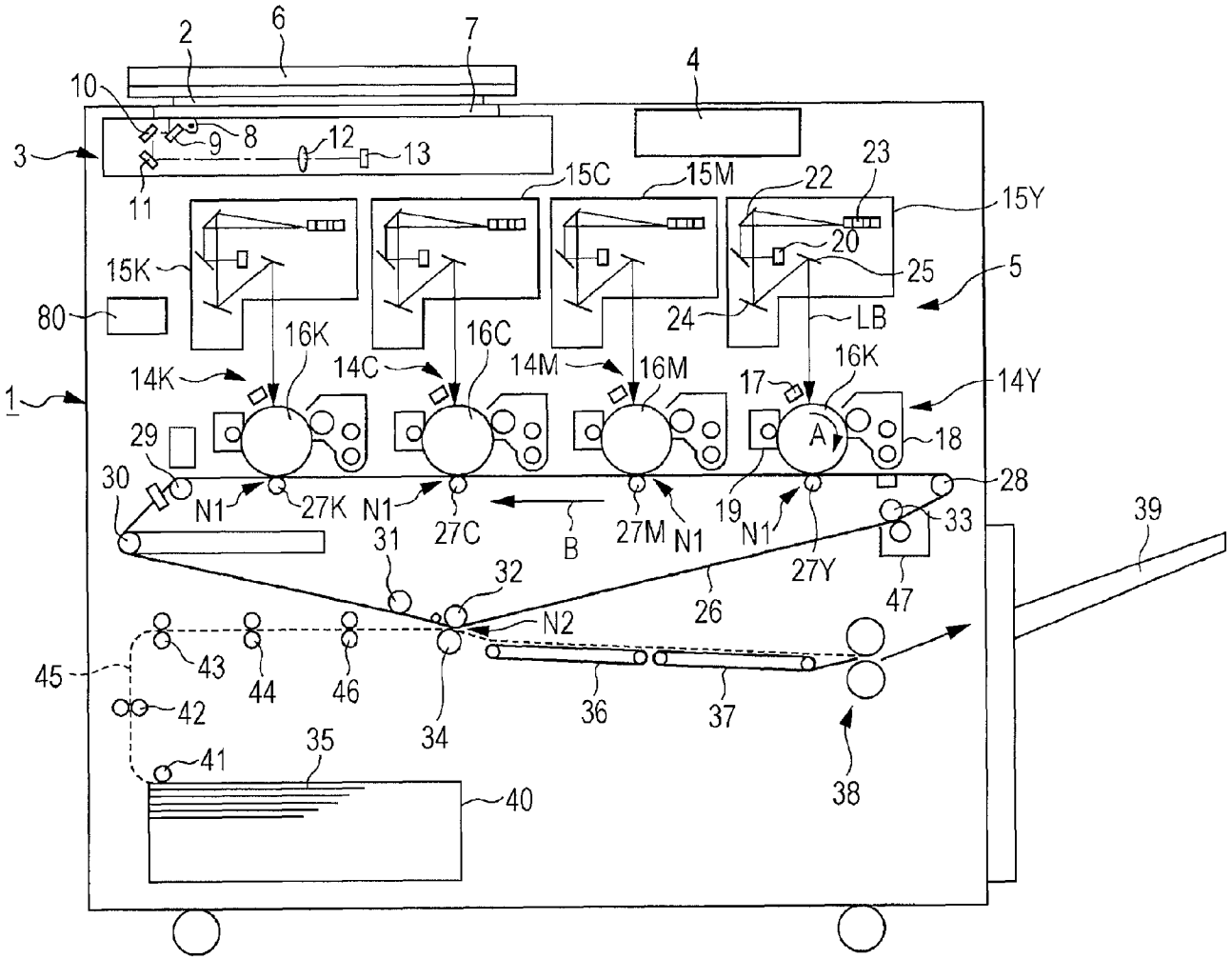
FIG. 17 is an overall view of an image forming apparatus including a transfer device according to a fourth exemplary embodiment of the present invention.

FIG. 17 illustrates a fourth exemplary embodiment of the present invention, in which the members the same as those of the first exemplary embodiment are denoted by the same numerals. In the fourth exemplary embodiment, the pressure applied to the prepressing member is controlled in accordance with environmental conditions.

Referring to FIG. 17, in the fourth exemplary embodiment, the image forming apparatus body 1 includes an environmental sensor 80 that detects at least one of the temperature and the humidity. In the present exemplary embodiment, the environmental sensor 80 detects both of the temperature and the humidity, and the pressure applied to the prepressing roller 60 is controlled on the basis of a detection result obtained by the environmental sensor 80.

Referring to FIG. 17, in the fourth exemplary embodiment, if the detection result obtained by the environmental sensor 80 indicates high temperature and high humidity, which implies that scattering of particles of a toner image is likely to occur, the pressing force with which the second transfer roller 34 is in pressed contact with the backup roller 32 and the prepressing roller 60 is set larger than a predetermined value in order to suppress scattering of particles of a toner image. If the detection result obtained by the environmental sensor 80 indicates low temperature and low humidity, which implies that scattering of particles of a toner image is not likely to occur, the pressing force with which the second transfer roller 34 comes into contact with the backup roller 32 and the prepressing roller 60 is set smaller than a predetermined value in order to suppress scattering of particles of a toner image, prevent an excessive pressure from being applied, and prevent or suppress occurrence of an image defect that may occur when an excessive concentration force is applied to the toner image 51.

Description of other structures and functions, which are the same as those of the first exemplary embodiment, is omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer member that transfers a toner image to a recording medium, the toner image being carried on an intermediate transfer member that rotates;

a facing member that is disposed so as to be in pressed contact with the transfer member with the intermediate transfer member therebetween; and a prepressing member that is disposed so as to be in pressed contact with the transfer member with the intermediate transfer member therebetween at a position that is upstream, in a direction in which the intermediate transfer member moves, of a contact section in which the facing member is in pressed contact with the transfer member and that is immediately behind a position at which the toner image carried on the intermediate transfer member starts to come into contact with the recording medium, wherein a pressure applied by the prepressing member is lower than a pressure with which the facing member is in pressed contact with the transfer member.

2. The transfer device according to claim 1, wherein both the transfer member and the prepressing member are roller-like members and an outer diameter of the prepressing member is smaller than an outer diameter of the transfer member.

3. The transfer device according to claim 2, wherein a bias voltage having a polarity that is the same as a polarity of toner of the toner image is applied to the facing member and a bias voltage having a polarity that is opposite to the polarity of the toner of the toner image is applied to the prepressing member.

4. The transfer device according to claim 3, wherein a pressure applied to the prepressing member is controlled in accordance with a thickness of the recording medium.

5. The transfer device according to claim 3, wherein a pressure applied to the prepressing member is controlled in accordance with an electric charge of the toner.

6. The transfer device according to claim 3, wherein a pressure applied to the prepressing member is controlled in accordance with environmental conditions.

7. The transfer device according to claim 2, wherein a pressure applied to the prepressing member is controlled in accordance with a thickness of the recording medium.

8. The transfer device according to claim 2, wherein a pressure applied to the prepressing member is controlled in accordance with an electric charge of the toner.

9. The transfer device according to claim 2, wherein a pressure applied to the prepressing member is controlled in accordance with environmental conditions.

10. The transfer device according to claim 1, wherein a bias voltage having a polarity that is the same as a polarity of toner of the toner image is applied to the facing member and a bias voltage having a polarity that is opposite to the polarity of the toner of the toner image is applied to the prepressing member.

11. The transfer device according to claim 10, wherein a pressure applied to the prepressing member is controlled in accordance with a thickness of the recording medium.

12. The transfer device according to claim 10, wherein a pressure applied to the prepressing member is controlled in accordance with an electric charge of the toner.

13. The transfer device according to claim 10, wherein a pressure applied to the prepressing member is controlled in accordance with environmental conditions.

14. The transfer device according to claim 1, wherein a pressure applied to the prepressing member is controlled in accordance with a thickness of the recording medium.

15. The transfer device according to claim 1, wherein a pressure applied to the prepressing member is controlled in accordance with an electric charge of the toner.

16. The transfer device according to claim 1, wherein a pressure applied to the prepressing member is controlled in accordance with environmental conditions.

17. An image forming apparatus comprising:

a plurality of image carriers that carry toner images in different colors;

a plurality of first transfer units that multi-transfer the toner images carried on the image carriers to an intermediate transfer member; and a second transfer unit that simultaneously second-transfers the toner images, which have been multi-transferred to the intermediate transfer member, to a recording medium, wherein the transfer device according to claim 1 is used as the second transfer unit.

* * * * *